US007338258B2

(12) United States Patent
Bachofner et al.

(10) Patent No.: US 7,338,258 B2
(45) Date of Patent: Mar. 4, 2008

(54) AXIALLY SEPARATE ROTOR END PIECE

(75) Inventors: René Bachofner, Untersiggenthal (CH); Wolfgang Kappis, Fislisbach (CH); Kurt Rubischon, Lengnau (CH)

(73) Assignee: ALSTOM Technology Ltd., Baden (CH)

( * ) Notice: Subject to any disclaimer, the term of this patent is extended or adjusted under 35 U.S.C. 154(b) by 177 days.

(21) Appl. No.: 11/276,186

(22) Filed: Feb. 17, 2006

(65) Prior Publication Data

US 2006/0188373 A1 Aug. 24, 2006

(30) Foreign Application Priority Data

Feb. 23, 2005 (CH) ..... 0322/05

(51) Int. Cl.
*F01D 5/32* (2006.01)

(52) U.S. Cl. ..... 416/215

(58) Field of Classification Search ..... 416/215, 416/216, 217, 218, 220 R, 221
See application file for complete search history.

(56) References Cited

U.S. PATENT DOCUMENTS

| | | | | |
|---|---|---|---|---|
| 2,406,703 | A * | 8/1946 | Morris | 416/216 |
| 3,252,687 | A * | 5/1966 | Beck et al. | 416/216 |
| 7,192,256 | B2 * | 3/2007 | Bachofner et al. | 416/212 A |

FOREIGN PATENT DOCUMENTS

| | | |
|---|---|---|
| CH | 223599 | 9/1942 |
| CH | 349624 | 10/1960 |
| DE | 812337 | 8/1951 |
| DE | 1751819 | 1/1971 |
| DE | 10310432 | 9/2004 |
| EP | 1028231 | 8/2000 |
| EP | 1215367 | 6/2002 |
| EP | 1457642 | 2/2004 |

OTHER PUBLICATIONS

Search Report for Swiss Patent App. No. 3222005, dated Jun. 2, 2005.

* cited by examiner

*Primary Examiner*—Edward K. Look
*Assistant Examiner*—Nathan Wiehe
(74) *Attorney, Agent, or Firm*—Cermak Kenealy & Vaidya LLP; Adam J. Cermak

(57) ABSTRACT

A rotor end piece (1) for a rotor of a thermal turbomachine, having at least one circumferential slot (3) in which press blades, intermediate pieces and two end blades (4), between which a residual gap is formed, are fitted, the rotor end piece (1) having two end piece halves (9, 9) and a wedge (7), is characterized in that a clip (8) is arranged in the residual gap, this clip (8) absorbing the forces of the two end piece halves (9, 9) and two shim halves (5, 6) arranged between the end piece halves (9, 9) and restrained with the wedge (7). As a result, the disadvantages of the prior art are avoided and a rotor end piece is provided which exerts no axial forces on the rotor and no forces on adjacent blades in the circumferential direction, so that an occurrence of disturbing rotor vibrations and jamming of adjacent blades is effectively avoided.

12 Claims, 4 Drawing Sheets

AXIALLY SEPARATE ROTOR END PIECE

This application claims priority under 35 U.S.C. § 119 to Swiss application number 00322/05 filed 23 Feb. 2005, the entirety of which is incorporated by reference herein.

BACKGROUND OF THE INVENTION

1. Field of the Invention

The invention relates to the field of thermal turbomachines, in particular to a rotor end piece for rotors, and to a method of fitting a rotor end piece.

2. Brief Description of the Related Art

Thermal turbomachines including axial-flow turbines and axial-flow compressors have a rotor fitted with moving blades and a stator in which guide blades are suspended in order to guide the flow.

The task of the stationary guide blades is to direct the flow of the gaseous medium to be compressed or expanded onto the rotating moving blades of the respective compressor stage or the respective turbine stage in such a way that the energy conversion is effected with the best possible efficiency.

Both moving blades and guide blades essentially have a profiled airfoil and a blade root. In order to be able to fasten the moving blades on the rotor or the guide blades in the stator, slots are recessed in the stator and on the rotor shaft. The roots of the blades are pushed into these slots and locked there.

It is known that compressor blade rows of gas turbine rotors are arranged in circumferential slots, which often have a T-shaped cross section. As a rule, blades and intermediate pieces alternate with one another here. During the fitting of such blade rows, a special solution has to be found for the last blades to be fitted, since the remaining fitting opening for a complete intermediate piece is then too small. This residual opening is therefore filled with a "rotor end piece".

DE 812 337 discloses such a rotor end piece. The known rotor end piece consists of an intermediate piece divided in half, that is to say of two end piece halves split in the circumferential direction with respect to the rotor, and of a wedge, by means of which the end piece halves are caulked in the rotor in the circumferential direction.

In the known prior art according to DE 812 337, the two end piece halves each have a straight side face. These side faces are opposite one another in the installed state, the wedge then being located between them. Once the two end piece halves and the wedge have been installed, the tabs formed on the top side of the wedge are finally bent into corresponding undercuts in the side faces of the end piece halves, and the wedge and thus the entire end piece are secured against flying out.

A disadvantage with this prior art is that, at high rotor speeds, strength problems may occur on account of the tilting moment of the two end piece halves, which is caused by the centrifugal force during operation.

A further disadvantage of these technical solutions consists in the fact that end pieces exert axial forces on the rotor, on the one hand due to the centrifugal force during operation and on the other hand due to the caulking of the wedge. In the search for the causes of the frequently occurring rotor vibrations, it has been found that these axial forces can bend the rotor and thereby adversely generate disturbing vibrations.

EP 1 215 367 A2 and DE 103 10 432 A1 describe solution proposals in which the forces are directed into the adjacent blades, i.e., in the circumferential direction. The solutions presented here are complicated and costly to fit and produce. In addition, rotor vibrations may also be caused by the introduction of the forces in the circumferential direction.

SUMMARY OF THE INVENTION

One aspect of the present invention is, therefore, in avoiding these disadvantages of the prior art. The technical problem forming a basis of the invention is to provide a rotor end piece which, as much as possible, exerts no axial forces on the rotor, so that the occurrence of disturbing rotor vibrations caused by axial forces is limited or avoided.

As a result, the disadvantages of the prior art can be avoided and a rotor end piece is provided which exerts no axial forces on the rotor and no forces on adjacent blades in the circumferential direction, so that an occurrence of disturbing rotor vibrations and jamming of adjacent blades is effectively avoided.

The rotor end piece according to the invention is characterized in that a clip is arranged in the residual gap, this clip absorbing the forces of the two end piece halves and two shim halves arranged between the end piece halves and restrained with the wedge. In this way, the forces acting in the axial direction on the slot and in the circumferential direction on adjacent blades in the known constructions of a rotor end piece are effectively avoided.

The advantages of the invention include the fact that it is now the clip, and not the rotor as in the prior art, that absorbs the axial forces caused by the centrifugal force and the prized-open wedge. As a result, disturbing vibrations are advantageously avoided.

An advantageous development of the invention provides for the opposite shim halves to each have an undercut into which wedge tabs arranged on the top side of the wedge can be spread. In this way, the wedge is secured in the pack to prevent it from flying out on account of the centrifugal forces.

A further advantageous development of the invention provides for the shim halves to have shim tabs above the undercuts, and these shim tabs can be driven via the spread wedge tabs. As a result, the wedge is additionally secured, since drifting-apart of the shim halves and associated release of the wedge tabs is reliably avoided.

Furthermore, it is advantageous that the pack of the two shim halves and the wedge is secured by beaded-over tabs of the end piece halves. This likewise involves an additional securing means, which takes effect if one of the preceding securing means fails.

It is especially advantageous that the clip is designed as an essentially rectangular plate with a longitudinal slot and a U-shaped cross section. In this case, a development of the invention provides for the U legs of the clip to engage in corresponding grooves of the end piece halves. The clip in this case is fitted in the circumferential slot in the axial direction, i.e., in the rotor longitudinal direction. The clip is in engagement both with the shim halves and with the end piece halves. The U legs are additionally virtually forced into the corresponding end piece halves by the centrifugal forces.

Yet another development of the present invention provides for corresponding projections of the shims to engage in the longitudinal slot of the clip. Alternatively, noses or webs on the shim halves can project downward and engage in the longitudinal slot of the clip. As a result, the shims driven apart by the wedge introduce force into the clip in the axial direction. Loading of the slot root in the axial direction is effectively avoided as a result.

Finally, a further advantageous embodiment of the present invention provides for the clip to be made of a chrome-molybdenum alloy. This advantageously meets the requirements for high strength with low weight of the component.

A method of fitting an axially separate rotor end piece, which has two end piece halves, two shim halves, a clip and a wedge, comprises the following steps: inserting the clip into the circumferential slot; fitting the two end piece halves, said end piece halves being brought into engagement with the clip; fitting the two shim halves, said shim halves likewise being brought into engagement with the clip; restraining the two shim halves in the axial direction by inserting the wedge. Removal is effected in the opposite sequence. In the process, the wedge tabs are bored out.

An advantageous development of the method of fitting an axially separate rotor end piece comprises the following steps: securing the wedge by spreading out the top wedge tabs into recesses of the shim halves and by beading over tabs of the shim halves; securing the shim halves and beading over tabs of the end piece halves. During removal, the beaded-over tabs are as a rule ground away.

BRIEF DESCRIPTION OF THE DRAWINGS

Further advantages of the invention are described in more detail below with reference to a preferred exemplary embodiment of the invention and the figures. In the drawing.

DETAILED DESCRIPTION OF EXEMPLARY EMBODIMENTS

In each case the same components are provided with the same designations. Furthemore, only the elements essential for the understanding of the invention are shown.

Figure 1:
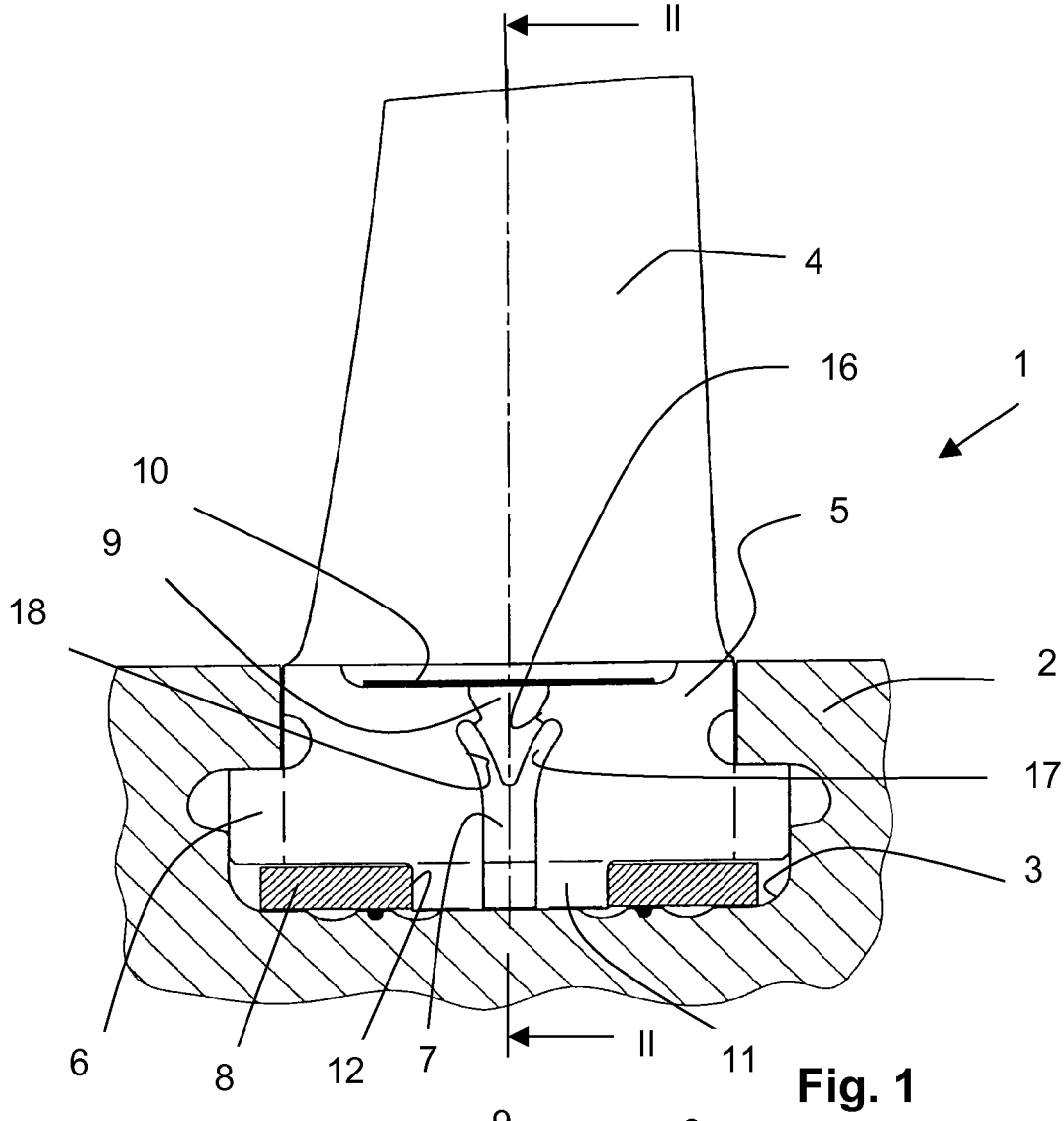
FIG. 1 shows a section in the rotor longitudinal direction through a rotor end piece according to the invention after it has been installed in a compressor rotor.
Figure 2:
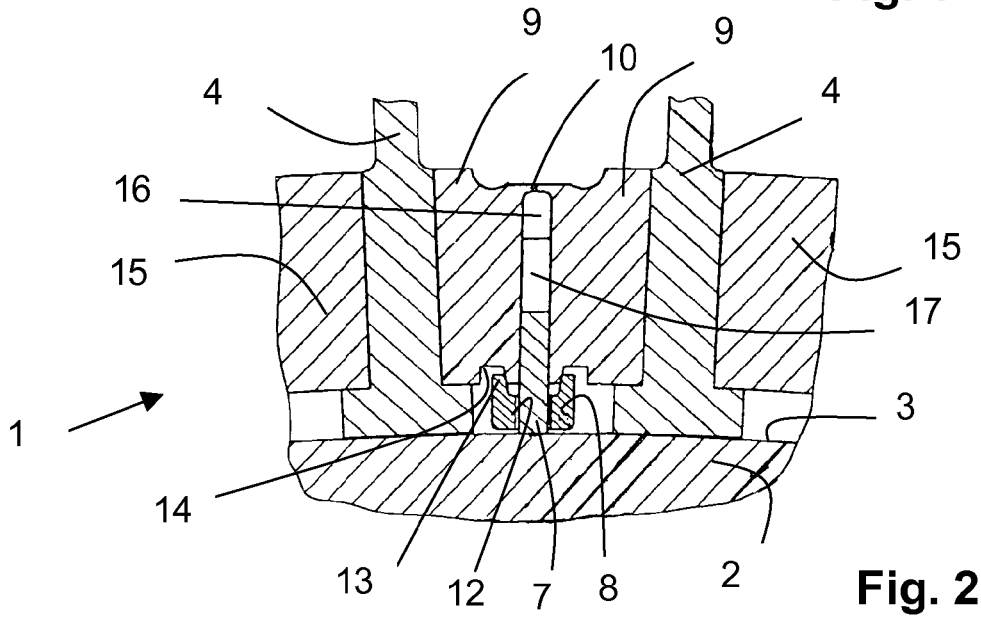
FIG. 2 shows a section in the circumferential direction along line II-II in FIG. 1.

FIG. 1 shows a section in the rotor longitudinal direction through a rotor end piece 1 according to the invention after it has been installed in a compressor rotor 6. FIG. 2 shows a partial section along line II-II in FIG. 1.

The detail shown in FIG. 1 and FIG. 2 represents a section of a circumferential rotor slot 3 of a compressor stage. All the press blades and intermediate pieces (not shown in this detail) and the end blades 4, 4 are fitted. The end blades 4, 4 differ from the regular press blades only in that the press bulge on the leading and trailing side is removed. Three separate end pieces are fitted into the residual gap remaining between the two end blades 4, 4. The axially separate rotor end piece has two end piece halves 9, 9, a first shim half 5, a second shim half 6, a clip 8 and a wedge 7 of chrome-nickel steel. The pack formed by the shim halves 5, 6 and the wedge 7, and the clip 8 and the end piece halves 9, 9 together have a mass comparable with an intermediate piece.

Figure 3:
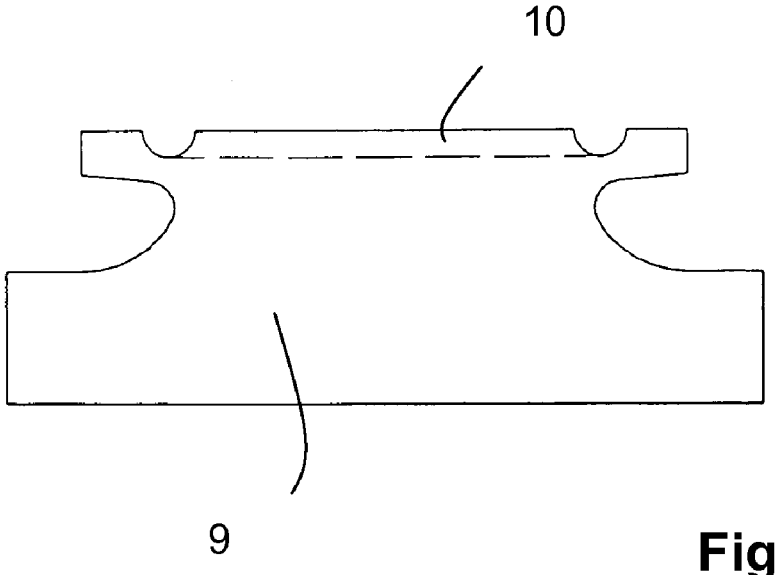
FIG. 3 shows a side view of an end piece half according to the invention.
Figure 4:
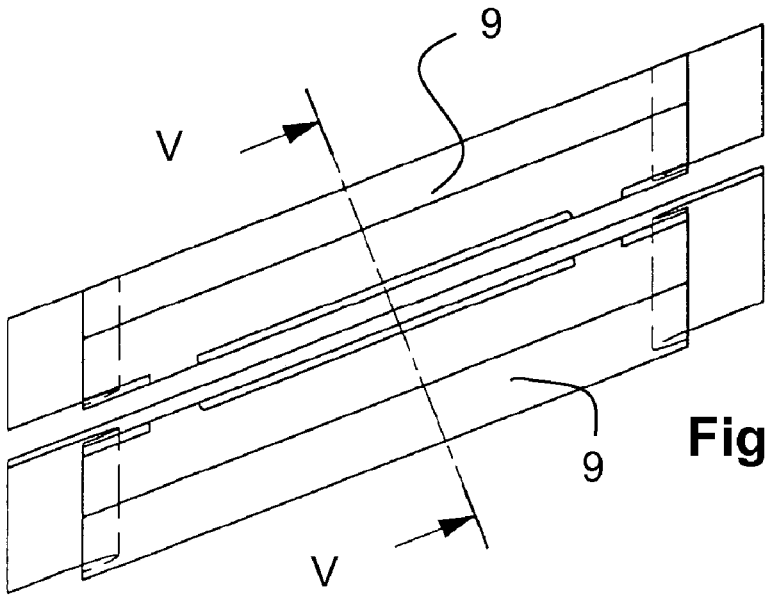
FIG. 4 shows a plan view of two end piece halves.
Figure 5:
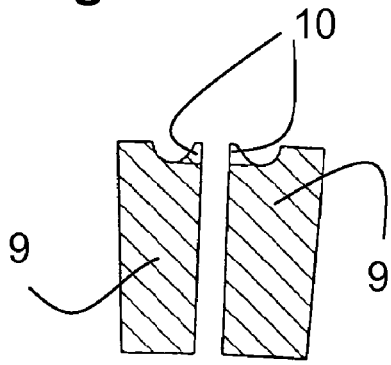
FIG. 5 shows a section along line V-V in FIG. 4.

FIG. 3 shows a side view of an end piece half 9, 9 according to the invention, and FIG. 4 shows a plan view of the two end piece halves. FIG. 5 shows a section along line V-V in FIG. 4. In the present exemplary embodiment, the two end piece halves 9, 9 are made of a chrome-nickel-molybdenum alloy. The outer contour of the end piece half 9 is in this case designed in such a way that it corresponds to the T-shaped cross section of the circumferential slot 3 of the rotor disk 2. Also shown in FIGS. 3 to 5 are the elongated webs or tabs 10 at the top margin of the end piece half 9, which are beaded over at the end of the fitting.

Figure 6:
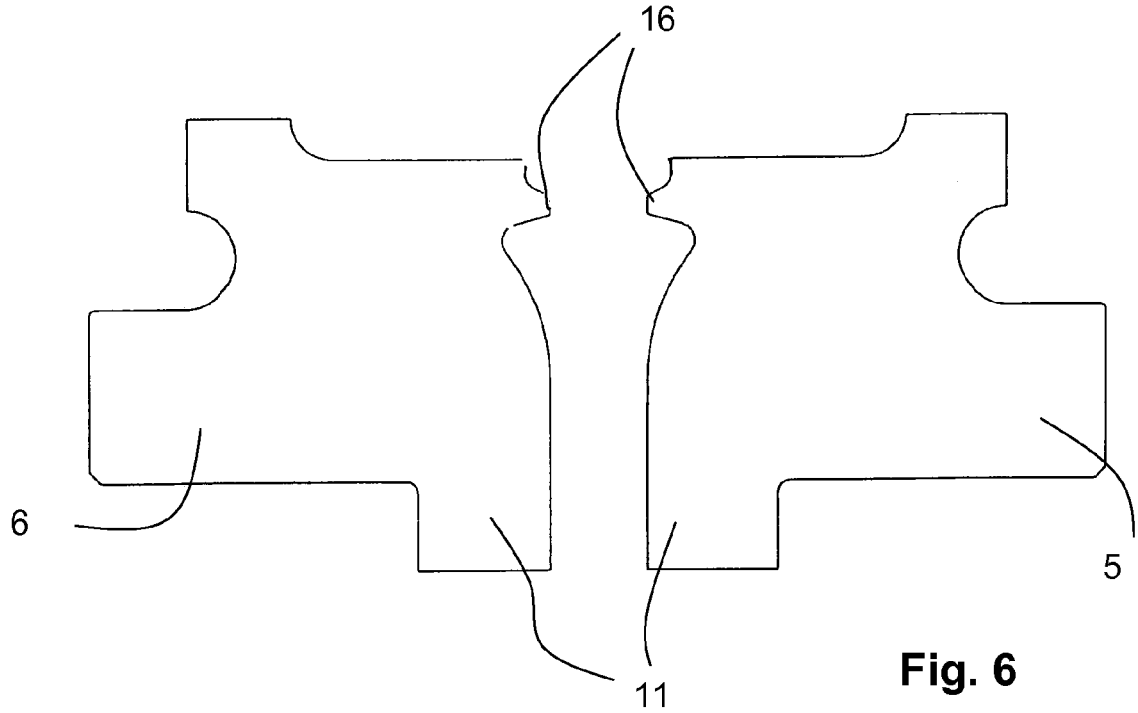
FIG. 6 shows a side view of two shims according to the invention.

FIG. 6 shows a side view of two shim halves 5, 6 according to the invention, which in the present exemplary embodiment are made of a chrome-nickel-molybdenum alloy. The clip 8 is the construction element which absorbs the axial forces in the present invention and thus provides for the relief of the rotor slot. In this case, the clip 8 is a metal profile of essentially rectangular design in plan view and having a central longitudinal slot or a central elongated aperture 12. The clip 8 has a U profile in cross section. The clip is in engagement with the end piece halves 9, 9 and the shim halves 5, 6 by means of the aperture 12 and the U legs 13. A fastening combination is thus formed together with the wedge 7.

Figure 7:
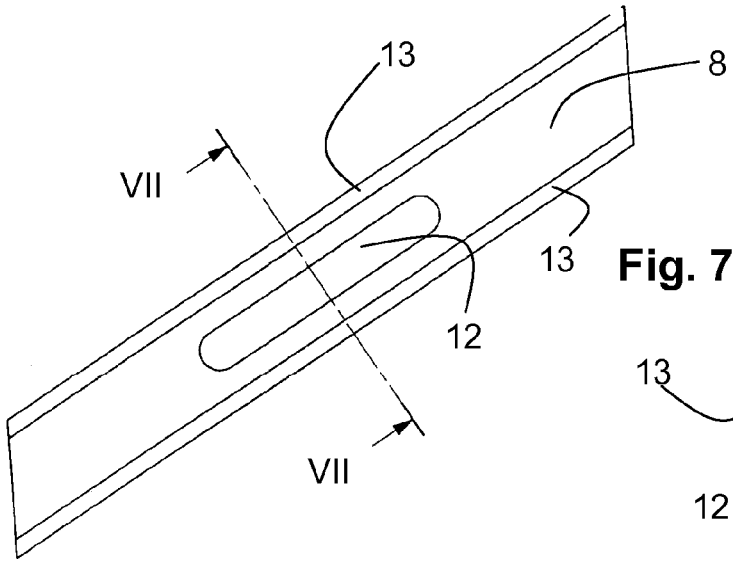
FIG. 7 shows a plan view of a clip according to the invention.
Figure 8:
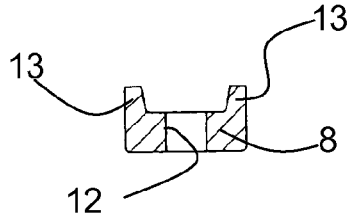
FIG. 8 shows a cross section along line VII-VII in FIG. 7.

FIG. 7 shows a detailed view of a clip 8 according to the invention. FIG. 8 shows a cross section through the clip 8 along line VII-VII in FIG. 7. In the present exemplary embodiment, the clip 8 is made of a chrome-molybdenum alloy.

Figure 9:
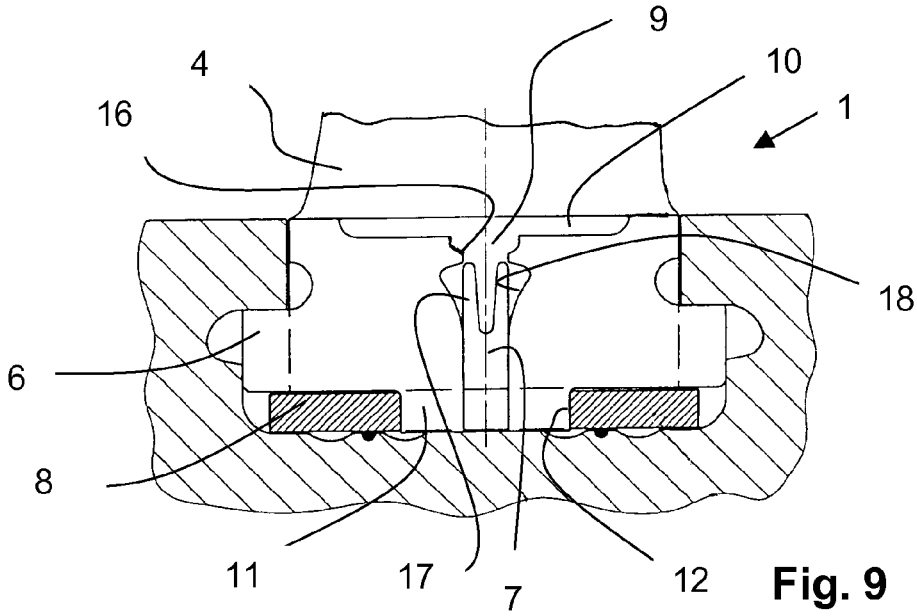
FIGS. 9 to 11 show, in section, various stages for fitting the rotor end piece according to the invention.
Figure 10:
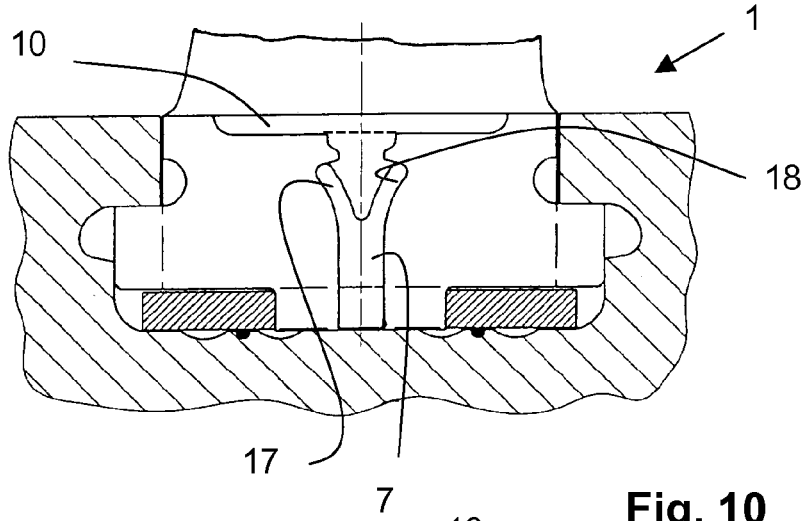
Figure 11:
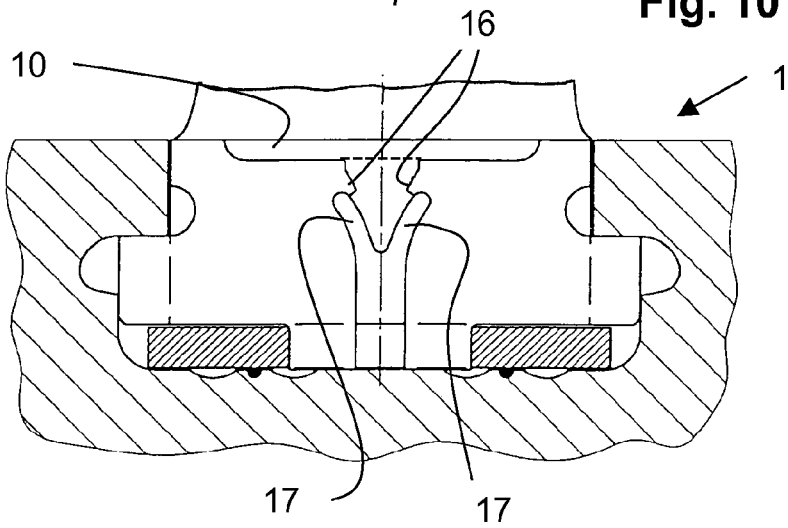

FIGS. 9 to 11 show in section various stages for fitting the rotor end piece 1 according to the invention.

In this case, a circumferential slot 3 having an essentially T-shaped cross section is recessed in the rotor disk 2. Press blades and intermediate pieces 15 are alternately fitted into this slot 3 until the two end blades 4 are fitted, between which a regular intermediate piece 15 can no longer be fitted on account of the small space in the residual gap.

Two end piece halves 9, 9 together with a clip 8 are installed via the residual gap. The end piece halves 9, 9 are driven apart in the circumferential direction. Two shim halves 5, 6 are then fitted and a wedge 7 is pushed in.

As shown in FIG. 10, the wedge tabs 7 are spread into the shim recesses 18, 18, which together produce a heart shape in side view. Then, as shown in FIG. 10, the shim tabs 16, 16 on the heart shape are driven via the spread wedge 7.

The pack formed by the shim halves 5, 6 and the wedge 7 is additionally secured by bending over the tabs 10, 10 of the end piece halves. The rotor end piece shown in FIG. 1 is obtained.

LIST OF DESIGNATIONS

1 Rotor end piece
2 Rotor disk
3 Circumferential slot
4 End blade
5 First shim half
6 Second shim half
7 Wedge
8 Clip
9 End piece half
10 Tab of end piece half
11 Shim projection
12 Clip aperture
13 U leg

14 Groove of end piece half
15 Intermediate piece
16 Shim tab
17 Wedge tab
18 Shim recess While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A rotor end piece for a rotor of a thermal turbomachine, the rotor having at least one circumferential slot in which moving blades, intermediate pieces, and two end blades, between which a residual gap is formed, are fitted, the rotor end piece comprising:

two end piece halves;

a wedge;

a clip configured and arranged to be positioned in the residual gap, said clip configured and arranged to absorb forces of the two end piece halves; and two shim halves arranged between the end piece halves and restrained with the wedge.

2. The rotor end piece as claimed in claim 1, wherein the wedge includes a top side having tabs, and wherein the shim halves each have an undercut into which said wedge tabs can be spread.

3. The rotor end piece as claimed in claim 2, wherein the shim halves each have shim tabs above the undercuts, configured and arranged to be driven by the wedge tabs when spread.

4. The rotor end piece as claimed in claim 1, wherein the end piece halves include tabs, and wherein a pack of the two shim halves and the wedge is secured by said end piece tabs beaded-over.

5. The rotor end piece as claimed in claim 1, wherein the clip comprises a rectangular plate with an aperture and a U-shaped cross section.

6. The rotor end piece as claimed in claim 5, wherein the end piece halves include grooves, and wherein the U-shaped cross section includes U legs which engage in corresponding grooves of the end piece halves.

7. The rotor end piece as claimed in claim 1, wherein the clip includes an aperture, and wherein the shims include projections which engage in the clip aperture.

8. The rotor end piece as claimed in claim 1, wherein the clip is made of a chrome-molybdenum-vanadium alloy.

9. A rotor of a thermal turbomachine, the rotor comprising:

a rotor including a circumferential slot; and a rotor end piece according to claim 1 positioned in said circumferential slot.

10. A rotor as claimed in claim 9, further comprising:

moving blades, intermediate pieces, and two end blades, between which two end blades a residual gap is formed, fitted in said circumferential slot;

wherein said clip is positioned in said residual gap.

11. A method of fitting an axially separate rotor end piece which has two end piece halves, two shim halves, a clip, and a wedge, the method comprising:

inserting the clip into a circumferential slot of a rotor;

fitting the two end piece halves, including bringing said two end piece halves into engagement with the clip;

fitting the two shim halves, including bringing said shim halves into engagement with the clip; and inserting the wedge to restrain the two shim halves in the axial direction.

12. The method of fitting an axially separate rotor end piece as claimed in claim 11, further comprising:

securing the wedge including spreading out top wedge tabs into recesses of the shim halves and beading over tabs of the shim halves; and securing the shim halves and beading over tabs of the end piece halves.

* * * * *